US011517778B2

(12) United States Patent
Simpson

(10) Patent No.: US 11,517,778 B2
(45) Date of Patent: Dec. 6, 2022

(54) FIRE SUPPRESSION SYSTEM HAVING A COMPOUND DISCHARGE NOZZLE

(71) Applicant: Kidde Technologies, Inc., Wilson, NC (US)

(72) Inventor: Terry Simpson, Wake Forest, NC (US)

(73) Assignee: KIDDE TECHNOLOGIES, INC., Wilson, NC (US)

( * ) Notice: Subject to any disclaimer, the term of this patent is extended or adjusted under 35 U.S.C. 154(b) by 411 days.

(21) Appl. No.: 16/598,477

(22) Filed: Oct. 10, 2019

(65) Prior Publication Data

US 2021/0106857 A1 Apr. 15, 2021

(51) Int. Cl.

| | |
|---|---|
| ***A62C 31/02*** | (2006.01) |
| ***A62C 3/08*** | (2006.01) |
| ***A62C 5/00*** | (2006.01) |
| ***A62C 99/00*** | (2010.01) |
| ***B05B 1/14*** | (2006.01) |
| ***A62C 31/05*** | (2006.01) |
| ***B05B 1/16*** | (2006.01) |

(52) U.S. Cl.

CPC ..... *A62C 31/02* (2013.01); *A62C 3/08* (2013.01); *A62C 5/008* (2013.01); *A62C 31/05* (2013.01); *A62C 99/0018* (2013.01); *B05B 1/14* (2013.01); *B05B 1/169* (2013.01)

(58) Field of Classification Search

CPC ..... A62C 31/05; A62C 31/02; A62C 3/08; A62C 5/008; A62C 99/0018; B05B 1/14; B05B 1/16; B05B 1/169

USPC ..... 169/9, 11, 16, 37, 46, 48, 62; 239/536, 239/548, 561, 587.1, 587.4

See application file for complete search history.

(56) References Cited

U.S. PATENT DOCUMENTS

| | | | | |
|---|---|---|---|---|
| 5,038,867 | A * | 8/1991 | Hindrichs | A62C 99/0018 169/62 |
| 7,080,793 | B2 | 7/2006 | Borisov et al. | |
| 8,915,307 | B2 | 12/2014 | Lelic et al. | |
| 2005/0183869 | A1* | 8/2005 | Lazzarini | B64D 25/00 169/48 |
| 2012/0118592 | A1* | 5/2012 | Lowry | F16K 31/002 239/548 |
| 2016/0096051 | A1* | 4/2016 | Baker | A62C 37/36 169/62 |

(Continued)

FOREIGN PATENT DOCUMENTS

| | | |
|---|---|---|
| EP | 3572127 A2 | 11/2019 |
| GB | 2106385 A | 4/1983 |
| GB | 2517794 A | 3/2015 |

OTHER PUBLICATIONS

European Search Report; Application No. 19212808.0-1113; dated Jul. 8, 2020; 7 pages.

*Primary Examiner* — Steven J Ganey

(74) *Attorney, Agent, or Firm* — Cantor Colburn LLP

(57) ABSTRACT

Disclosed is a fire suppressant system for an aircraft having: a source of a fire suppressant; a tubing system for delivering the fire suppressant to one or more predetermined locations; and a discharge nozzle disposed in the one or more predetermined locations, the discharge nozzle connected to the tubing system for distributing the fire suppressant in the one or more predetermined locations during a fire, the discharge nozzle including a plurality of nozzle heads including a first nozzle head with a first flow area and a second nozzle head with a second flow area that differs from the first flow area.

17 Claims, 4 Drawing Sheets

(56) References Cited

U.S. PATENT DOCUMENTS

| | | | |
|---|---|---|---|
| 2016/0367931 | A1 | 12/2016 | Yin et al. |
| 2018/0161793 | A1 | 6/2018 | Disimile |
| 2019/0168047 | A1 | 6/2019 | Conboy |

* cited by examiner

FIRE SUPPRESSION SYSTEM HAVING A COMPOUND DISCHARGE NOZZLE

BACKGROUND

Exemplary embodiments pertain to the art of fire suppression systems for an aircraft and more specifically to a fire suppression system having a compound discharge nozzle.

For the protection of aircraft engine, auxiliary power units (APU) and cargo compartments use Halon 1301 as the fire suppressant. Many of the currently used vaporizing liquids (FICs and FICs blends of HFCs, fluoroketone FK-5.1.12, fluoro-olefins) may be unsuitable as they have relatively high boiling points than Halon 1301 and may not disperse as efficiently particularly at low temperatures.

BRIEF DESCRIPTION

Disclosed is a fire suppressant system for an aircraft comprising: a source of a fire suppressant; a tubing system for delivering the fire suppressant to one or more predetermined locations; and a discharge nozzle disposed in the one or more predetermined locations, the discharge nozzle connected to the tubing system for distributing the fire suppressant in the one or more predetermined locations during a fire, the discharge nozzle including a plurality of nozzle heads including a first nozzle head with a first flow area and a second nozzle head with a second flow area that differs from the first flow area.

In addition to one or more of the above disclosed aspects or as an alternate the first nozzle head is disposed on a first centerline and the second nozzle head is disposed on a second centerline, wherein the first centerline and the second centerline are skewed relative to one another.

In addition to one or more of the above disclosed aspects or as an alternate the first nozzle head and the second nozzle head are movable to change an orientation of the first centerline and the second centerline.

In addition to one or more of the above disclosed aspects or as an alternate, the system includes at least a third nozzle head with a third flow area that differs from the first flow area and the second flow area.

In addition to one or more of the above disclosed aspects or as an alternate the third nozzle head is disposed on a third centerline that is skewed relative to the first centerline and the second centerline.

In addition to one or more of the above disclosed aspects or as an alternate the third nozzle head is movable to change an orientation of the third centerline.

In addition to one or more of the above disclosed aspects or as an alternate the one or more predetermined locations includes a forward cargo bay and an aft cargo bay; the discharge nozzle is a forward discharge nozzle connected to a forward end of the tubing system; the system includes an aft discharge nozzle disposed in the aft cargo bay and connected to an aft end of the tubing system for delivering the fire suppressant to the aft cargo bay; and the source of the fire suppressant includes one or more bottles connected to the tubing system intermediate the forward end and the aft end of the tubing system.

In addition to one or more of the above disclosed aspects or as an alternate the fire suppressant is a mixture one of: HFC-23 and CF3H; HFC-125 and CF3CF2H; HFC-227ea and CF3CFHCF3; Novec 1230 and CF3CF2C=OCF(CF3)2; and Solstice, HCFO-1233zd(E) and CF3CH=CClH.

Further disclosed is an aircraft comprising: a fire suppressant system that includes one or more of the above disclosed aspects.

In addition to one or more of the above disclosed aspects or as an alternate the one or more predetermined locations includes a forward cargo bay and an aft cargo bay; the discharge nozzle is a forward discharge nozzle connected to a forward end of the tubing system; the system includes an aft discharge nozzle disposed in the aft cargo bay and connected to an aft end of the tubing system for delivering the fire suppressant to the aft cargo bay; the source of the fire suppressant includes one or more bottles connected to the tubing system intermediate the forward end and the aft end of the tubing system.

Further disclosed is a method of fire suppressing a fire in one or more predetermined locations of an aircraft, comprising: transporting a fire suppressant in a tubing system from a source of the fire suppressant to a discharge nozzle in the one or more predetermined locations; distributing the fire suppressant from the discharge nozzle into the one or more predetermined locations, through a first nozzle head having a first flow area and a second nozzle head having a second flow area that differs from the first flow area.

In addition to one or more of the above disclosed aspects or as an alternate distributing the fire suppressant comprises distributing the fire suppressant from the first nozzle head along a first discharge path and from the second nozzle head along a second discharge path, wherein the first discharge path and the second discharge path are skewed relative to one another.

In addition to one or more of the above disclosed aspects or as an alternate distributing the fire suppressant comprises distributing the fire suppressant from the discharge nozzle into the one or more predetermined locations, through a third nozzle head having a third flow area that differs from the first flow area and the second flow area.

In addition to one or more of the above disclosed aspects or as an alternate distributing the fire suppressant comprises distributing the fire suppressant from the third nozzle head along a third discharge path, wherein the first discharge path, the second discharge path and the third discharge path are skewed relative to one another.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
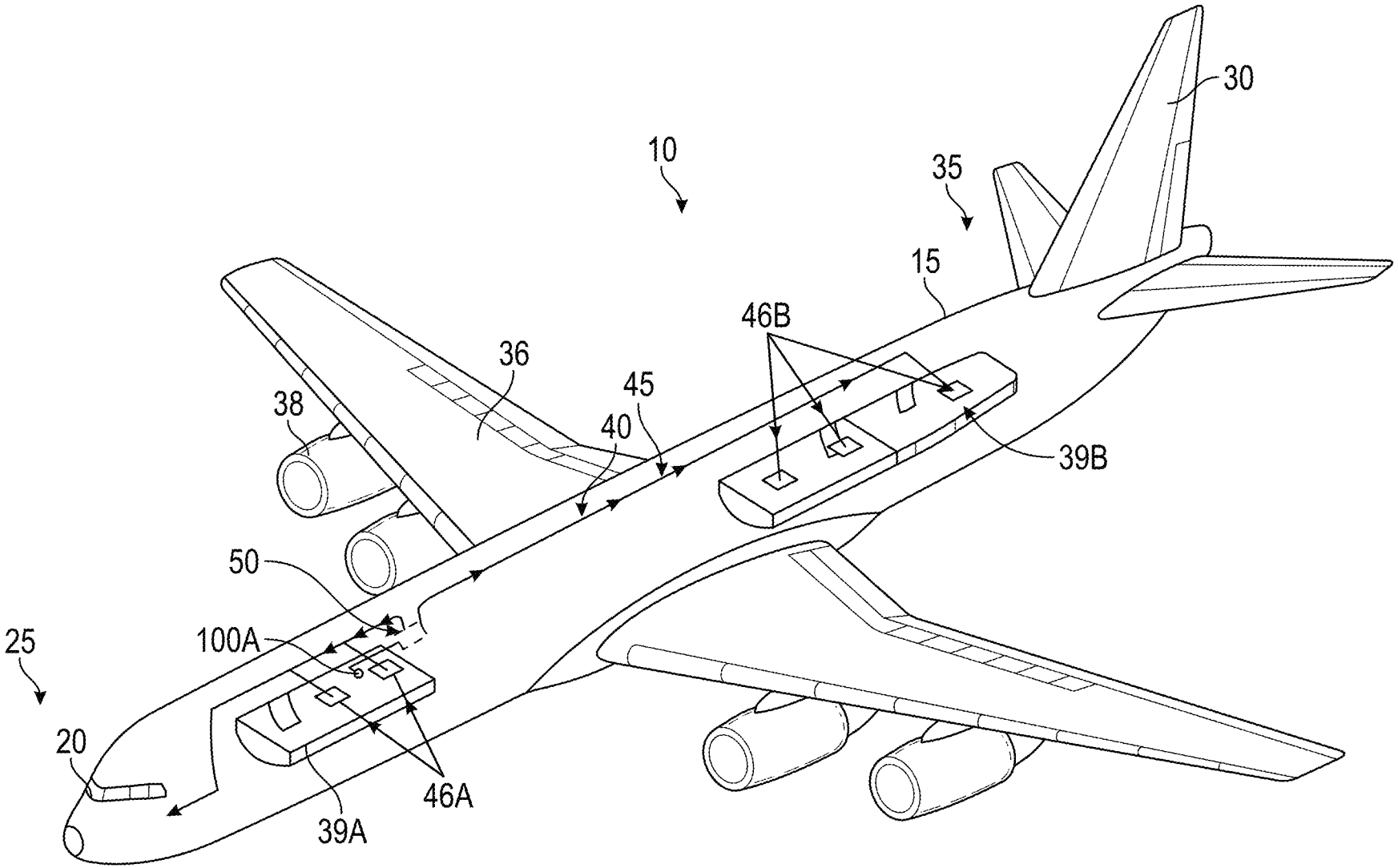
FIG. 1 shows an aircraft that may include a fire suppressant system with a discharge head according to an embodiment.

Turning to FIG. 1, an aircraft 10 is illustrated that may benefit from aspects of the disclosed embodiments. The aircraft 10 may include a fuselage 15, with a cockpit 20 at the forward end 25 and a tail 30 at the aft end 35. The aircraft 10 may include a pair of wings 36. Each of the wings 36 may have one or more engines 38. Distributed between the forward end 25 and aft end 35 may be a plurality of cargo bays 39 including a forward cargo bay 39A and an aft cargo bay 39B. When used in the singular, cargo bay can refer to either the forward cargo bay 39A or the aft cargo bay 39B. A fire suppression system 40 may be included for suppressing fires in one or more predetermined locations, which may include the cargo bay 39. As illustrated, the fire suppression system 40 may include a monitoring system 45. The monitoring system 45 which may include a plurality of detectors 46 including forward detectors 46*a* in the forward cargo bay 39A and aft detectors 46B in the aft cargo bay 39B. Of course, the system could be included in only one of the bays.

The monitoring system 45 may electronically communicate with the cockpit 20 for the purpose of transmitting warnings when a fire is detected.

The fire suppression system 40 may include a plurality of fire suppressant storing canisters, otherwise referred to as a pack of bottles 50 (illustrated schematically in FIG. 1). The pack of bottles 50, which may include one or more bottles depending on demands of the fire suppression system 50. The pack of bottles 50 are generally stored next to one of the cargo bays 39. Suppressant may be discharged into the forward cargo bay 39A or aft cargo bay 39B during a fire. The probability of a cargo fire in any one of the cargo bays 39 is low, and the likelihood of two simultaneous fires in both cargo bays 39 is lower. Because of this, it is not required to have separate packs of bottles 50 for each of the cargo bays 39. One pack of bottles 50 typically provides suppression capability to the cargo bays 39.

Figure 2:
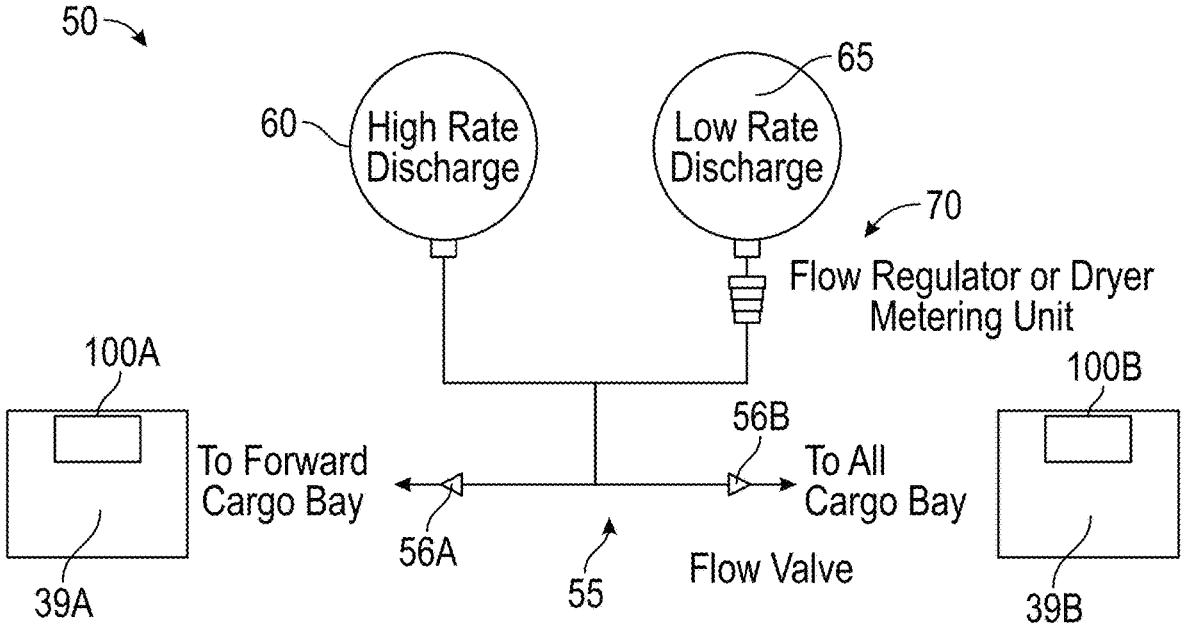
FIG. 2 shows a fire suppressant system that may include a discharge head according to an embodiment.

FIG. 2 further illustrates the pack of bottles 50. The pack of bottles 50 are discharged through a tubing system 55 that distributes suppressant to a plurality of discharge nozzles 100. The plurality of discharge nozzles 100 includes for example a forward discharge nozzle 100A in the forward cargo bay 39A and an aft discharge nozzle 100B in the aft cargo by 39B. The discharge nozzles 100 have a same configuration so the forward discharge nozzle 100A may be generally referred to herein as a discharge nozzle.

The tubing system 55 may include a plurality of flow valves 56. For example a forward flow valve 56A and an aft flow valve 56B may be provided in the tubing system 55. The fire suppression system 40 may operate to provide an initial high-rate knockdown discharge of fire suppressant during a fire, followed by a low-rate metered discharge of fire suppressant. This is intended to keep a fire suppressed for continued safe flight and landing at the nearest suitable airport. Thus, between the flow valves 56, a first bottle 60 of the bottles 50 is configured as a high-rate discharge bottle and is initially discharged to knock down flames and suppresses a fire. The first bottle 60 of the bottles 50 may include, for example, a minimum of five (5) percent concentration by volume of Halon, for example Halon 1301.

A second discharge of fire suppressant comes from a second bottle 65 of the bottles 50. Flow from the second bottle 65 of the bottles 50 is metered by a flow regulator 70. That is, the second bottle 65 of the bottles 50 is configured as low-rate metered discharge bottle. The second discharge occurs at the same time as the initial knockdown discharge or after a predetermined time delay. The second discharge provides, for example, a steady-state suppressant flow rate. For example, when the bottles are filled with Halon, the flow rate will maintain a Halon concentrations of, for example, three (3) percent for a specified duration.

A challenge with discharging suppressant in the cargo bays 39 is that suppressant may not reach an entirely of an area impacted by fire. For example, a suppressant throw by the discharge nozzles 100 may not be far enough, or may be too far relative to a location of a fire.

Figure 3:
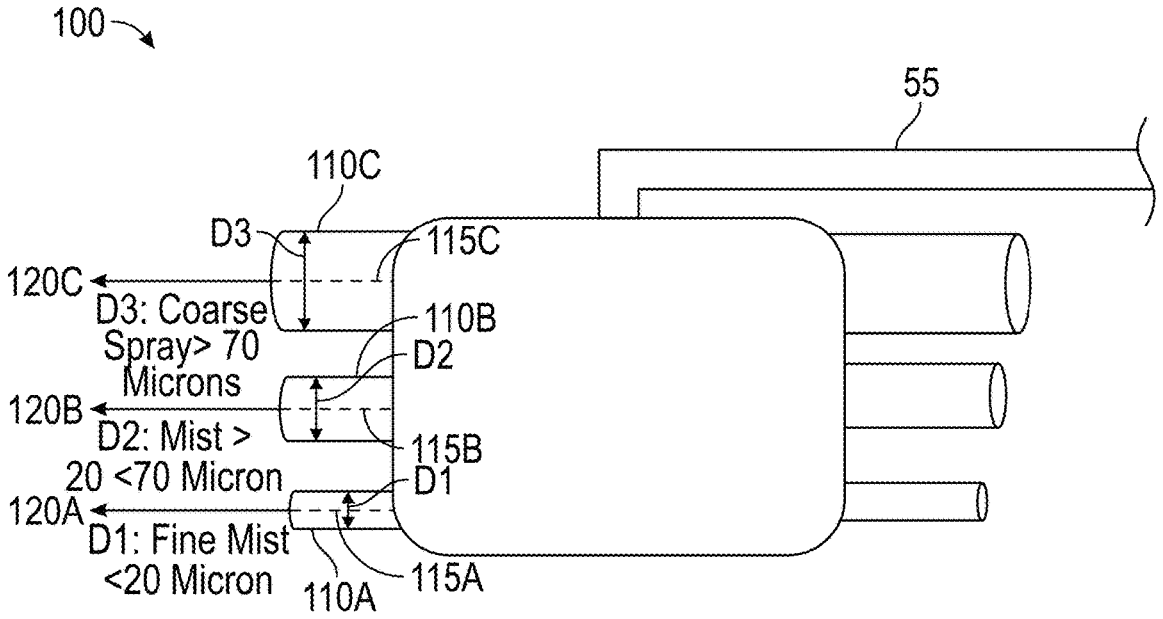
FIG. 3 shows a discharge head according to an embodiment.
Figure 4:
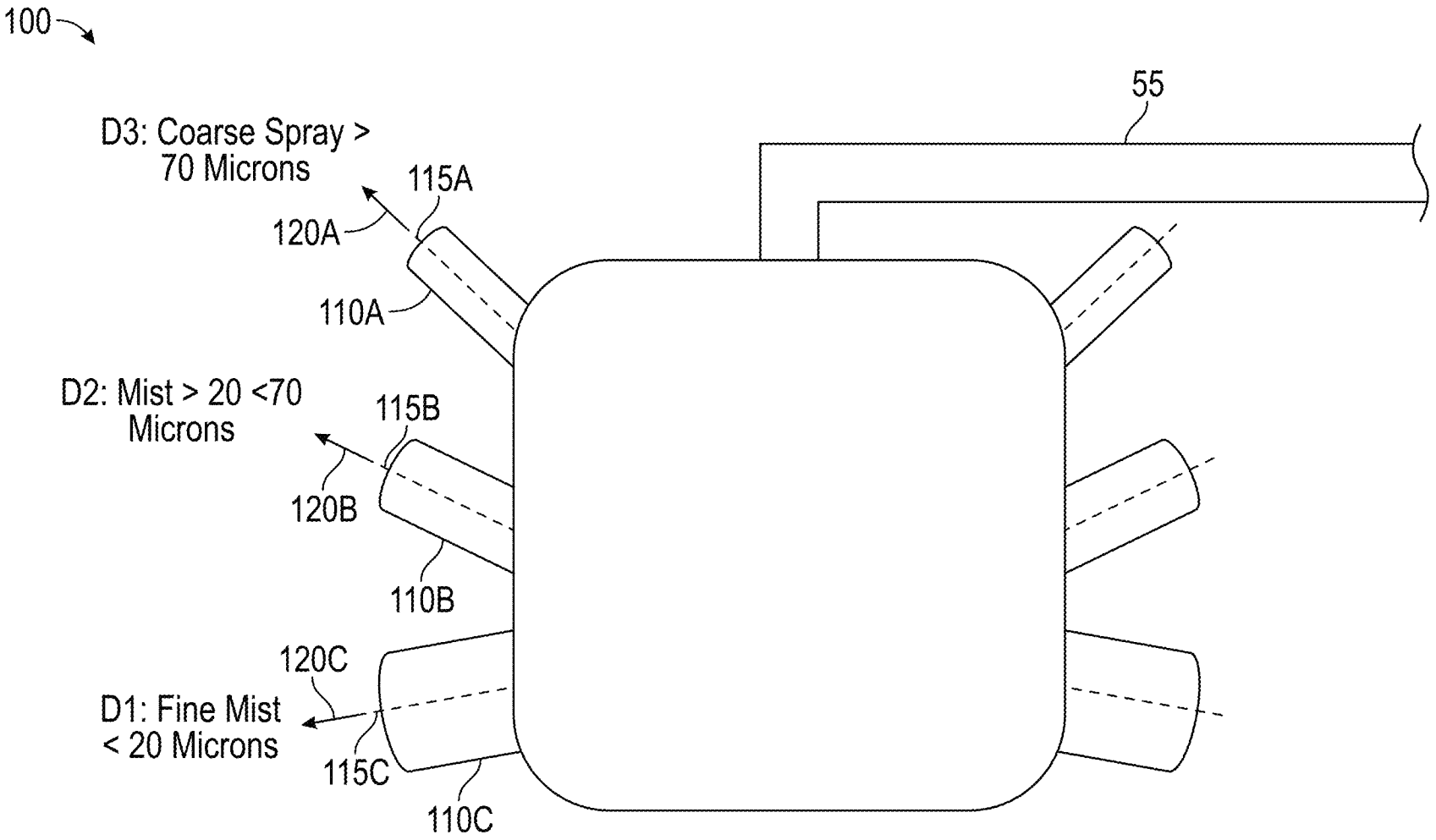
FIG. 4 shows a discharge head according to an embodiment.

Turning to FIGS. 3 and 4, in view of the identified challenges, and according to the disclosed embodiments, the discharge nozzles 100 are configured as compound nozzles. As indicated, the forward discharge nozzle 100A is representative of the discharge nozzles 100 and it includes a plurality of nozzle heads 110. A first nozzle head 110A has a first flow area defined by a first diameter opening D1 (FIG. 3). A second nozzle head 110B has a second flow area defined by a second diameter opening D2 (FIG. 3). A third nozzle head 110C has a third flow area defined by a third diameter opening D3 (FIG. 3). The first diameter opening D1 is smaller than the second diameter opening D2. The second diameter opening D2 is smaller than the third diameter opening D3. Of course the utilization of additional nozzles with additional diameter openings is within the scope of the disclosure.

The different diameters are selected to provide a predetermined throw for suppressant that is disbursed by the forward discharge nozzle 100A. For example, droplet size generated by D1 may be 20 microns or less, droplet size generated by D2 may be 20-70 microns and droplet size generated by D3 may be 70 to 200 microns. The smaller diameter for the first nozzle head 110A compared with the other ones of the nozzle heads 110 will result in a more rapid atomization of fire suppressant from the first nozzle head 110A than the other ones of the nozzle heads 110. Similarly, the smaller diameter for the second nozzle head 110B compared with the third nozzle head 110C will result in a more rapid atomization of fire suppressant from the second nozzle head 110B than the third nozzle head 110C. Non-atomized suppressant throws further than atomized suppressant. Therefore the configuration of the forward discharge nozzle 100A in FIGS. 3 and 4 throws suppressant to a plurality of distances relative to the forward discharge nozzle 100A, i.e., near, far and intermediated distances.

The nozzle heads 110 are disposed along respective centerlines 115. This includes a first centerline 115A for the first nozzle head 110A, a second centerline 115B for the second nozzle head 110B and a third centerline 115C for the third nozzle head 110C. As a result the fire suppressant is discharged along respective discharge paths 120. This includes a first discharge path 120A for suppressant discharged from the first nozzle head 110A, a second discharge path 120B for suppressant discharged from the second nozzle head 110B and a third discharge path 120C for suppressant discharged from the third nozzle head 110C.

In the embodiment illustrated in FIG. 3, the centerlines 115, and as a result the discharge paths 120, are parallel. As illustrated in FIG. 4, the centerlines 115, and as a result the discharge paths 120, are skewed relative to one another. That is, the discharge paths 120 are non-parallel. Thus, in the embodiment illustrated in FIG. 4, suppressant distributed from the nozzle heads 110 will be respectively distributed along mutually skewed discharge paths 140.

In one embodiment the nozzle heads 110 are adjustable, to thereby change an orientation of the centerlines 115, and, accordingly, an orientation of the discharge paths 120. This configuration provides an array of fire suppressant distribution patterns. The distribution patterns may be selected based on the load distribution in the cargo bays 39 or any reconfiguration of the cargo bay 39.

The embodiments utilize a mixture of sizings of nozzle heads 110 in a discharge nozzles 100 are that configured as a compound nozzles. The disclosed configuration may be used with pure suppressants for example or blends. Examples of blending agents include: (1) HFC-23, CF3H; (2) HFC-125 CF3CF2H; (3) HFC-227ea, CF3CFHCF3; (4) Novec 1230 CF3CF2C=OCF(CF3)2; (5) Solstice, HCFO-1233zd(E), CF3CH=CClH; and (6) Other HCFOs or HFOs. Efficient agent vaporization and distribution provides a more efficient design of the fire protection system 40 by optimizing agent weight and volume to generate desired agent concentrations. Thus, depending on a blend of selected sizes of the nozzle heads 110, it is possible to circumvent the identified challenges associated with known systems and derive a solution that meets air-framer's needs.

Figure 5:
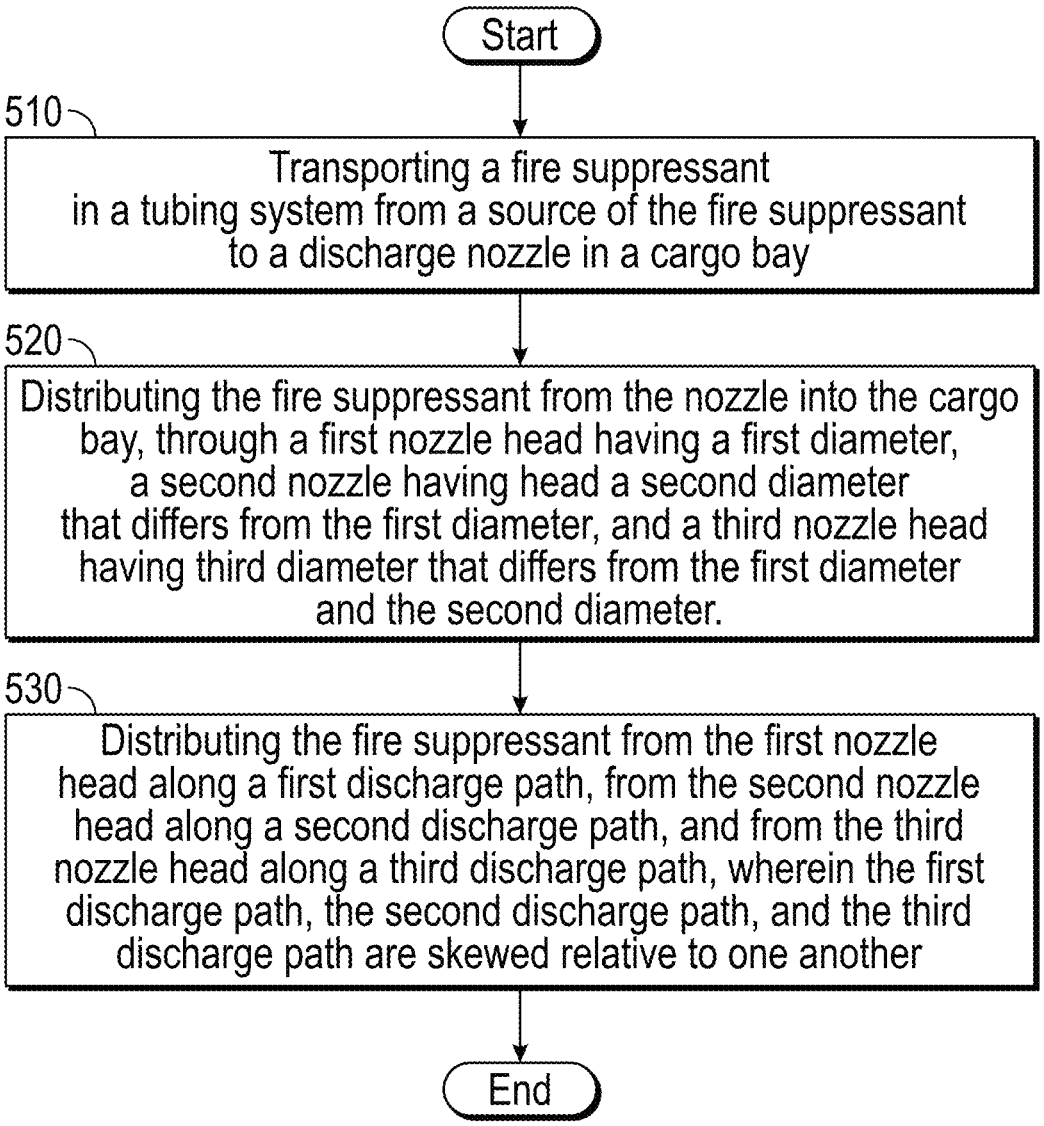
FIG. 5 shows a method of distributing fire suppressant to one or more cargo bays in an aircraft.

Turning to FIG. 5, a flow chart shows a method of distributing fire suppressant to cargo bays 39, for example the forward cargo bay 39A, in an aircraft 10. As shown in block 510, the method includes transporting the fire suppressant in a tubing system 55 from a suppressant source, i.e., the pack of bottles 50, to a forward discharge nozzle 100A in the forward cargo bay 39A. As shown in block 520 the method includes distributing the fire suppressant from the forward discharge nozzle 100A into the forward cargo bay 39A, through a first nozzle head 110A having a first diameter D1, a second nozzle head 110B having a second diameter D2 that differs from the first diameter D1, and a third nozzle head 110C having a third diameter D3 that differs from the first diameter D1 and the second diameter D2. As shown in block 530 the method includes distributing the fire suppressant from the first nozzle head 110A along a first discharge path 120A, from the second nozzle head 110B along a second discharge path 120B, and from the third nozzle head 110C along a third discharge path 120C. The first discharge path 120A, the second discharge path 120B and the third discharge path 120C are skewed relative to one another.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A fire suppressant system for an aircraft comprising:

a source of a fire suppressant;

a tubing system for delivering the fire suppressant to one or more predetermined locations; and a discharge nozzle disposed in the one or more predetermined locations, the discharge nozzle connected to the tubing system configured to distribute the fire suppressant in the one or more predetermined locations during a fire, the discharge nozzle including a first nozzle head with a first diameter opening having a first flow area and a second nozzle head with a second diameter opening having a second flow area that differs from the first flow area, and including at least a third nozzle head with a third flow area that differs from the first flow area and the second flow area, wherein:

the first nozzle head has the first flow area defined by the first diameter opening, the second nozzle head has the second flow area defined by the second diameter opening, the third nozzle head has the third flow area defined by a third diameter opening, the first diameter opening is smaller than the second diameter opening, and the second diameter opening is smaller than the third diameter opening, so that a the first diameter opening is configured to generate a droplet size of 20 microns or less, the second diameter opening is configured to generate a droplet size of 20-70 microns and the third diameter opening is configured to generate a droplet size of 70 to 200 microns.

2. The system of claim 1, wherein the first nozzle head is disposed on a first centerline and the second nozzle head is disposed on a second centerline, wherein the first centerline and the second centerline are skewed relative to one another.

3. The system of claim 2, wherein the first nozzle head and the second nozzle head are movable to change an orientation of the first centerline and the second centerline.

4. The system of claim 2, wherein the third nozzle head is disposed on a third centerline that is skewed relative to the first centerline and the second centerline.

5. The system of claim 4, wherein the third nozzle head is movable to change an orientation of the third centerline.

6. The system of claim 5, wherein:

the one or more predetermined locations includes a forward cargo bay and an aft cargo bay;

the discharge nozzle is a forward discharge nozzle being disposed in the forward cargo bay and connected to a forward end of the tubing system for delivering the fire suppressant to the forward cargo bay;

the system includes an aft discharge nozzle disposed in the aft cargo bay and connected to an aft end of the tubing system for delivering the fire suppressant to the aft cargo bay; and the source of the fire suppressant includes one or more bottles connected to the tubing system intermediate the forward end and the aft end of the tubing system.

7. The system of claim 6, wherein the fire suppressant is a mixture one of:

HFC-23 and CF3H;

HFC-125 and CF3CF2H;

HFC-227ea and CF3CFHCF3;

Novec 1230 and CF3CF2C=OCF(CF3)2; and

Solstice, HCFO-1233zd(E) and CF3CH=CClH.

8. An aircraft comprising:

a fire suppressant system that includes:

a source of a fire suppressant;

a tubing system for delivering the fire suppressant to one or more predetermined locations; and a discharge nozzle disposed in the one or more predetermined locations, the discharge nozzle connected to the tubing system for distributing the fire suppressant in the one or more predetermined locations during a fire, the discharge nozzle including a plurality of nozzle heads including a first nozzle head with a first flow area and a second nozzle head with a second flow area that differs from the first flow area, and including at least a third nozzle head with a third flow area that differs from the first flow area and the second flow area, wherein:

the first nozzle head has the first flow area defined by a first diameter opening, the second nozzle head has the second flow area defined by a second diameter opening, the third nozzle head has the third flow area defined by a third diameter opening, the first diameter opening is smaller than the second diameter opening, and the second diameter opening is smaller than the third diameter opening, so that a the first diameter opening is configured to generate a droplet size of 20 microns or less, the second diameter opening is configured to generate a droplet size of 20-70 microns and the third diameter opening is configured to generate a droplet size of 70 to 200 microns.

9. The aircraft of claim 8, wherein the first nozzle head is disposed on a first centerline and the second nozzle head is disposed on a second centerline, wherein the first centerline and the second centerline are skewed relative to one another.

10. The aircraft of claim 9, wherein the first nozzle head and the second nozzle head are movable to change an orientation of the first centerline and the second centerline.

11. The aircraft of claim 10, wherein the third nozzle head is disposed on a third centerline that is skewed relative to the first centerline and the second centerline.

12. The aircraft of claim 11, wherein the third nozzle head is movable to change an orientation of the third centerline.

13. The aircraft of claim 12, wherein:

the one or more predetermined locations includes a forward cargo bay and an aft cargo bay;

the discharge nozzle is a forward discharge nozzle being disposed in the forward cargo bay and connected to a forward end of the tubing system for delivering the fire suppressant to the forward cargo bay;

the system includes an aft discharge nozzle disposed in the aft cargo bay and connected to an aft end of the tubing system for delivering the fire suppressant to the aft cargo bay; and the source of the fire suppressant includes one or more bottles connected to the tubing system intermediate the forward end and the aft end of the tubing system.

14. The aircraft of claim 13, wherein the fire suppressant is a mixture one of:

HFC-23 and CF3H;

HFC-125 and CF3CF2H;

HFC-227ea and CF3CFHCF3;

Novec 1230 and CF3CF2C=OCF(CF3)2; and

Solstice, HCFO-1233zd(E) and CF3CH=CClH.

15. A method of fire suppressing a fire in one or more predetermined locations of an aircraft, comprising:

transporting a fire suppressant in a tubing system from a source of the fire suppressant to a discharge nozzle in the one or more predetermined locations;

distributing the fire suppressant from the discharge nozzle into the one or more predetermined locations, through a first nozzle head having a first flow area and a second nozzle head having a second flow area that differs from the first flow area, and distributing the fire suppressant comprises distributing the fire suppressant from the discharge nozzle into the one or more predetermined locations, through a third nozzle head having a third flow area that differs from the first flow area and the second flow area, wherein:

the first nozzle head has the first flow area defined by a first diameter opening, the second nozzle head has the second flow area defined by a second diameter opening, the third nozzle head has the third flow area defined by a third diameter opening, the first diameter opening is smaller than the second diameter opening, and the second diameter opening is smaller than the third diameter opening, so that a the first diameter opening is configured to generate a droplet size of 20 microns or less, the second diameter opening is configured to generate a droplet size of 20-70 microns and the third diameter opening is configured to generate a droplet size of 70 to 200 microns.

16. The method of claim 15 wherein distributing the fire suppressant comprises distributing the fire suppressant from the first nozzle head along a first discharge path and from the second nozzle head along a second discharge path, wherein the first discharge path and the second discharge path are skewed relative to one another.

17. The method of claim 16, wherein distributing the fire suppressant comprises distributing the fire suppressant from the third nozzle head along a third discharge path, wherein the first discharge path, the second discharge path and the third discharge path are skewed relative to one another.

* * * * *